US006715557B2

(12) United States Patent
Wetzel et al.

(10) Patent No.: US 6,715,557 B2
(45) Date of Patent: Apr. 6, 2004

(54) TOOL STRING

(75) Inventors: Rodney J. Wetzel, Katy, TX (US); Stephen Meschall, Andar (BR); Dennis M. Read, Manvel, TX (US); Clay W. Milligan, Jr., Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 49 days.

(21) Appl. No.: 10/097,477

(22) Filed: Mar. 14, 2002

(65) Prior Publication Data

US 2002/0129942 A1 Sep. 19, 2002

Related U.S. Application Data

(60) Provisional application No. 60/275,853, filed on Mar. 14, 2001.

(51) Int. Cl.[7] ..... E21B 34/14

(52) U.S. Cl. ..... 166/373; 166/386; 166/322; 166/332.3

(58) Field of Search ..... 166/373, 374, 166/378, 386, 319, 322, 332.4, 332.3

(56) References Cited

U.S. PATENT DOCUMENTS

| | | | | | |
|---|---|---|---|---|---|
| 3,570,595 | A | * | 3/1971 | Berryman | 166/128 |
| 3,763,933 | A | * | 10/1973 | Mott | 166/322 |
| 3,796,257 | A | * | 3/1974 | Hudson | 166/363 |
| 4,253,522 | A | * | 3/1981 | Setterberg, Jr. | 166/278 |
| 4,372,388 | A | | 2/1983 | Skinner | |
| 4,651,829 | A | * | 3/1987 | Hushbeck et al. | 166/321 |
| 4,700,777 | A | | 10/1987 | Luers | |
| 4,858,690 | A | * | 8/1989 | Rebardi et al. | 166/278 |
| 5,305,833 | A | | 4/1994 | Collins | |
| 6,006,838 | A | * | 12/1999 | Whiteley et al. | 166/306 |
| 6,227,298 | B1 | * | 5/2001 | Patel | 166/321 |
| 6,230,807 | B1 | * | 5/2001 | Patel | 166/321 |

FOREIGN PATENT DOCUMENTS

| | | |
|---|---|---|
| GB | 2 370 052 | 6/2002 |

* cited by examiner

*Primary Examiner*—David Bagnell
*Assistant Examiner*—Daniel P Stephenson
(74) *Attorney, Agent, or Firm*—Trop, Pruner & Hu PC; Jeffrey Griffin; Brigitte Jeffery Echols

(57) ABSTRACT

A tool string for deployment in a wellbore includes an upper string and a lower string. The upper string includes a valve actuator, and the lower string includes a valve. The lower string is adapted to receive the upper string, and the valve actuator controls the operation of the valve once the upper string is received by the lower string.

49 Claims, 5 Drawing Sheets

TOOL STRING

This application claims the benefit of U.S. Provisional Patent Application Serial No. 60/275,853, filed on Mar. 14, 2001.

BACKGROUND

1. Field of the Invention

This invention pertains to tool strings, and particularly to retrievable tool strings used for underbalanced well completions.

2. Related Art

It is often desirable to isolate a portion of a well. For example, a portion of the well may be isolated during insertion or retrieval of a work string. It may also be desirable to isolate a portion of a well during perforation operations, particularly during underbalanced completion operations.

SUMMARY OF THE INVENTION

The present invention enables the retrieval of a completion string while maintaining control of a well without having to kill the well (i.e., without having to exceed formation pressure) each time the string is retrieved.

DETAILED DESCRIPTION

Referring to FIGS. 1A–1H, tool string 10 includes an upper string 12 and a lower string 14. In one embodiment, upper string 12 and lower string 14 are deployed into the wellbore as a unit. In another embodiment, lower string 14 is deployed and located in the wellbore first. Subsequently, upper string 12 is deployed and stabbed into lower string 14.

Figure 1A:
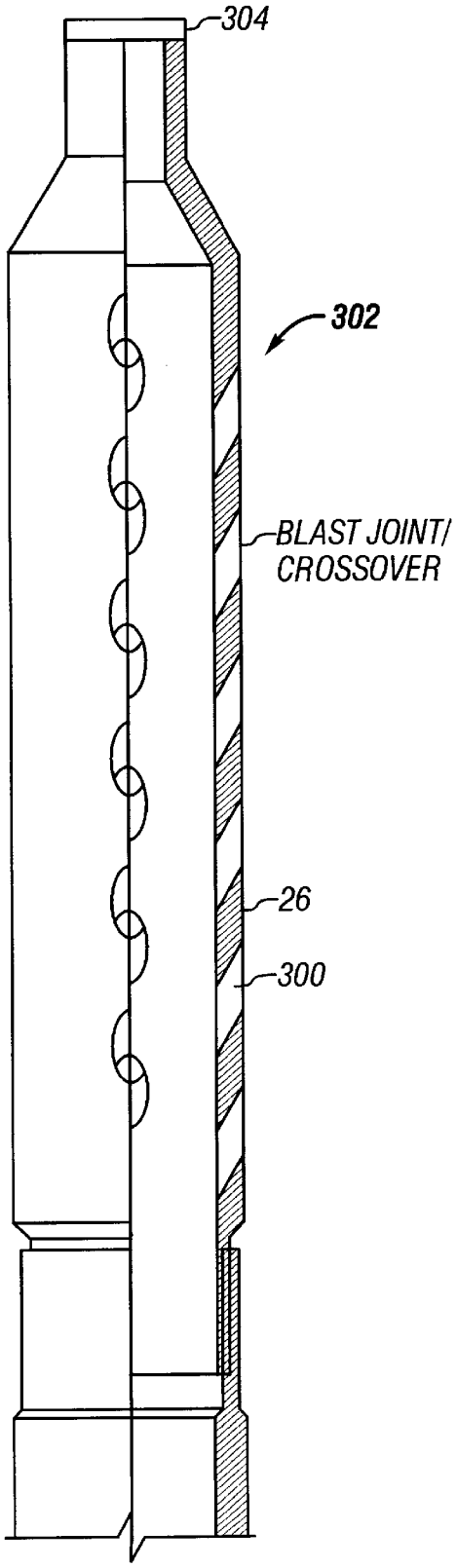
FIGS. 1A–1H are schematic views of a tool string constructed in accordance with the present invention, each figure showing contiguous portions (with slight overlap) of the tool string.
Figure 1B:
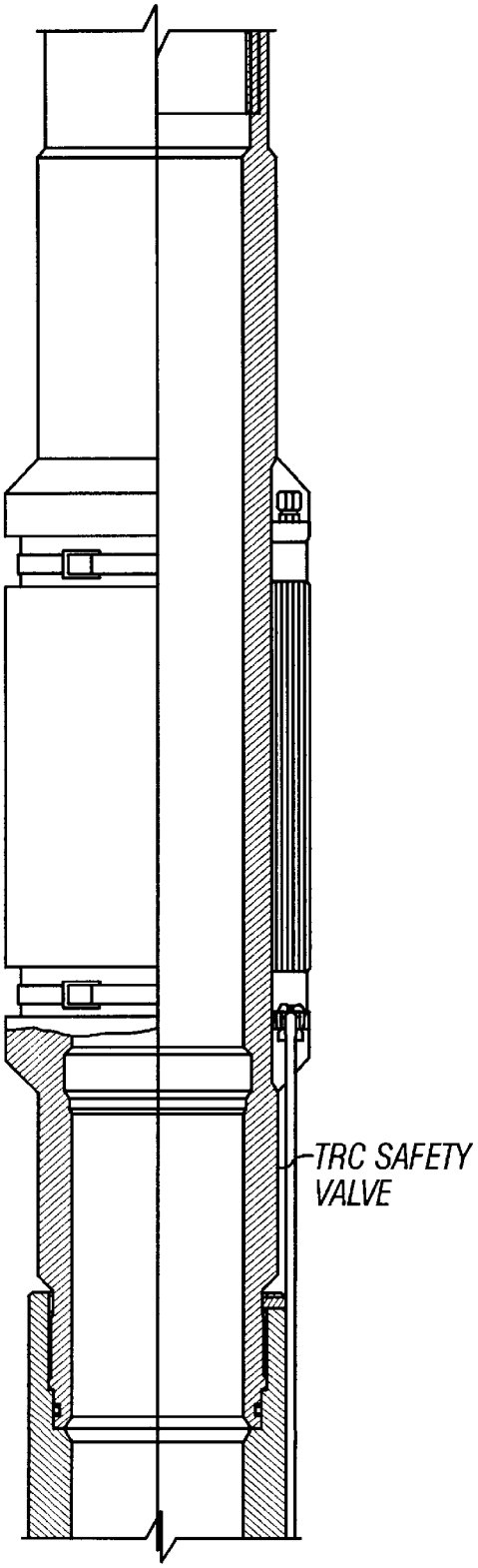
Figure 1C:
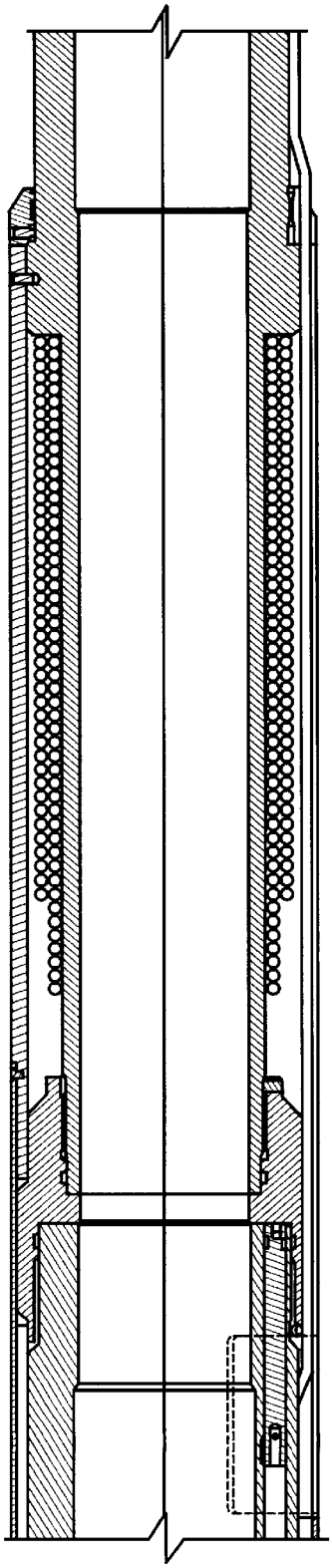
Figure 1D:
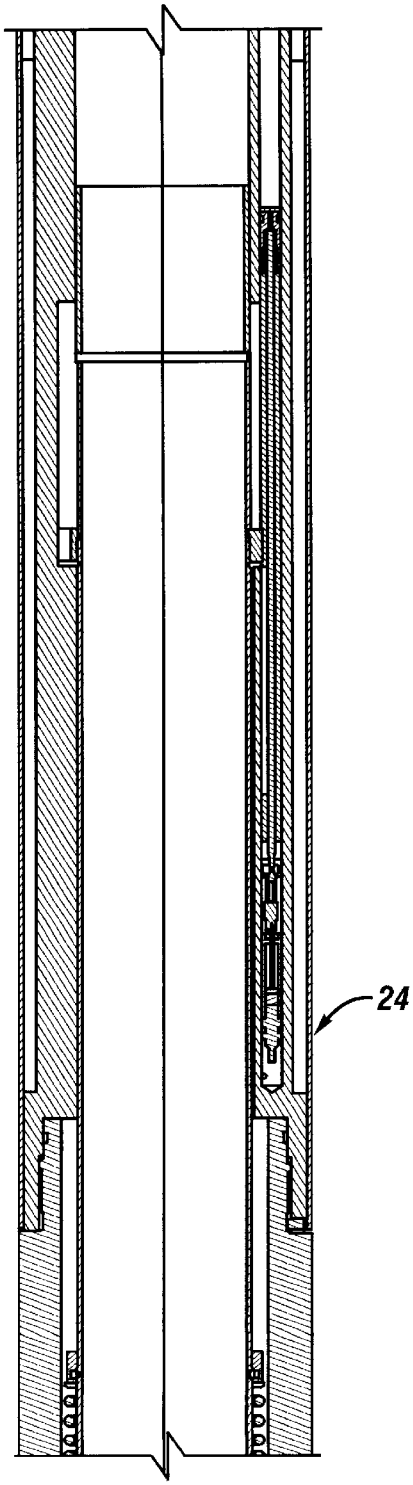
Figure 1E:
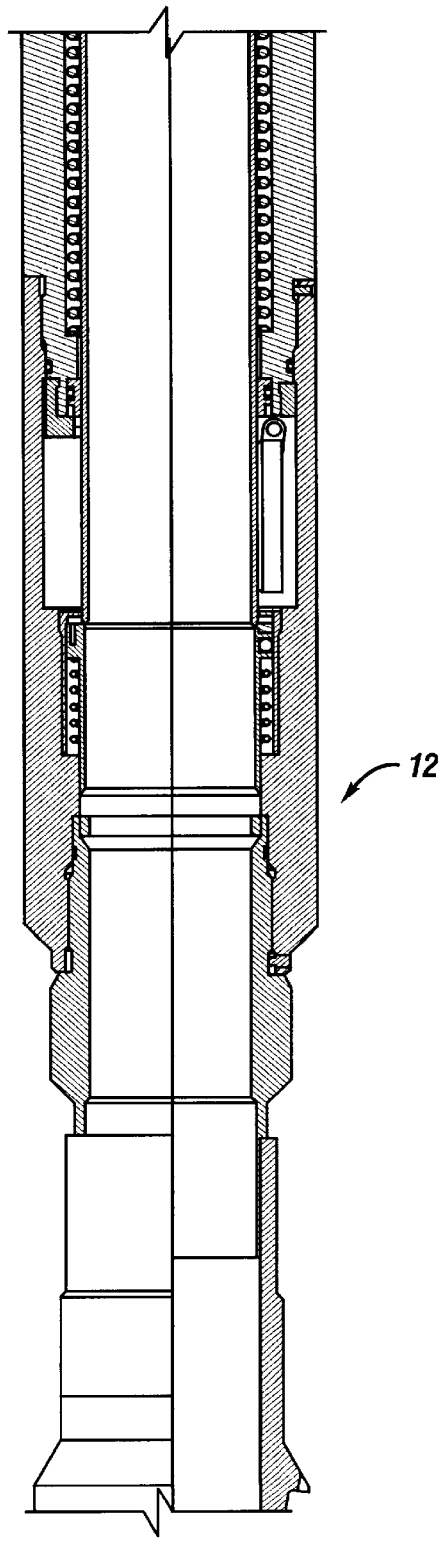

Lower string 14 includes a valve 20 that prohibits flow through a tool string passageway 18 when valve 20 is in the closed position, but permits flow through passageway 18 when valve 20 is in the open position. In the embodiment of FIG. 1H, valve 20 comprises a ball valve that is operated by a ball operator mandrel 22. Sliding movement of ball operator mandrel 22 induces the opening or closing of ball valve 20, as is known in the art. Ball operator mandrel 22 includes a ball collet 32 (FIG. 1G) that releasably locks ball operator mandrel 22 (and ball valve 20) in the open and closed positions. Fingers 34 of ball collet 32 are disposed within a lower ball groove 36 defined on an interior surface of a lower housing 38 when ball valve 20 is in the open position (as shown in FIG. 1G). Ball valve 20 is, in the configuration shown, releasably locked in the open position. Sliding movement of ball operator mandrel 22 in the upward direction causes fingers 34 to snap out of lower ball groove 36 and slide on the interior surface of lower housing 38 until fingers 34 snap into an upper ball groove 40 defined on the interior surface of lower housing 38. Ball valve 20 is, in that configuration, releasably locked in the closed position. Ball valve 20 may be moved between the closed and open positions any number of times by sliding ball operator mandrel 22 in the upward and downward directions.

Figure 1F:
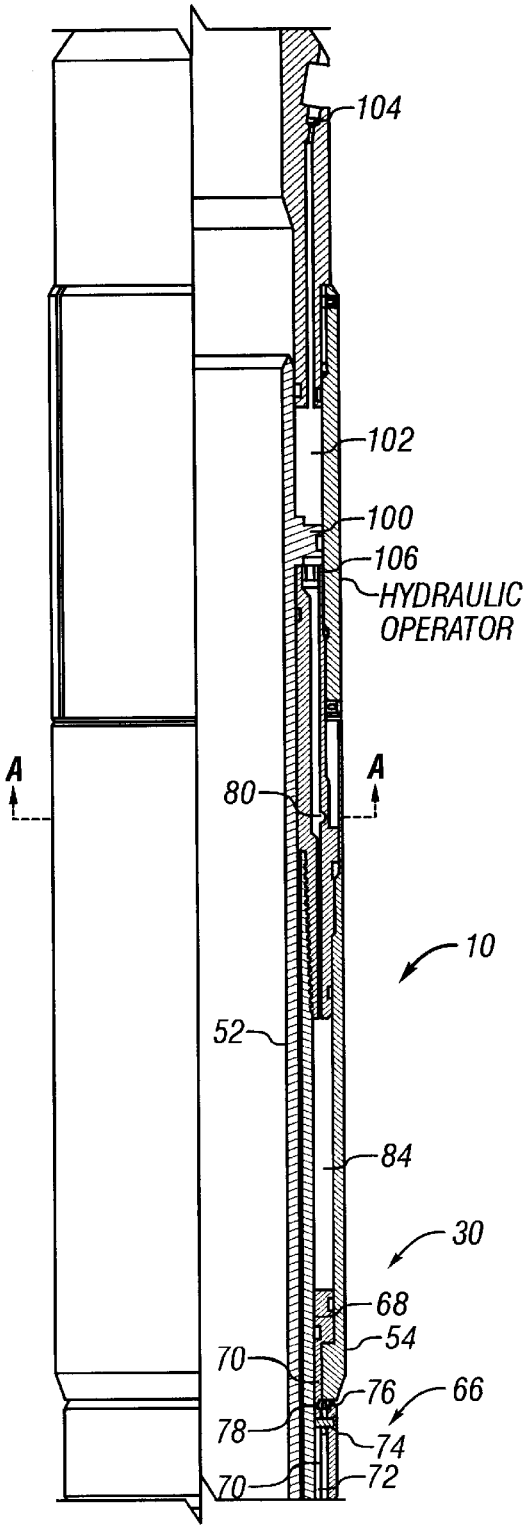
Figure 1G:
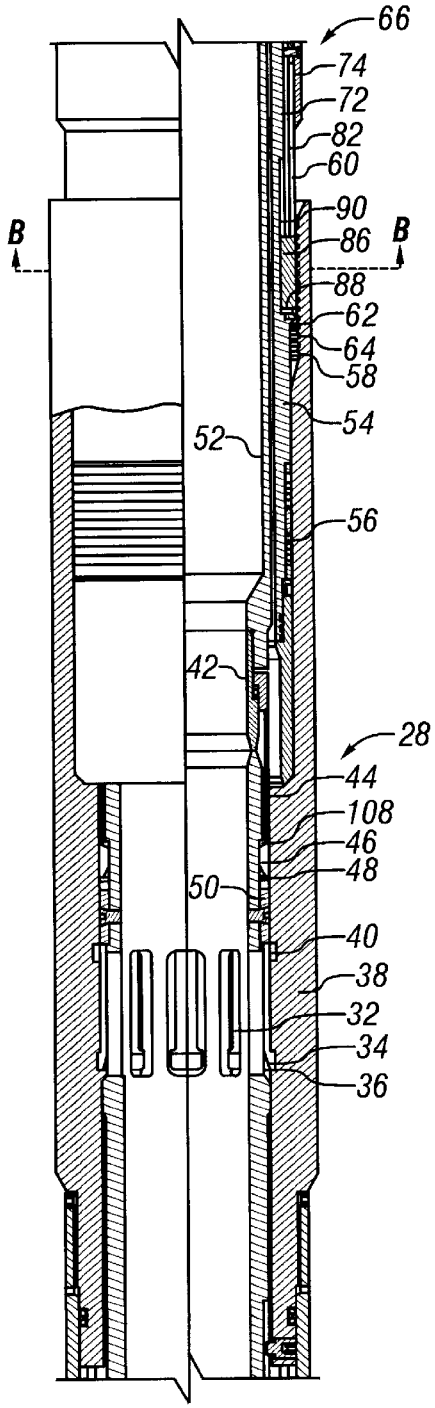
Figure 1H:
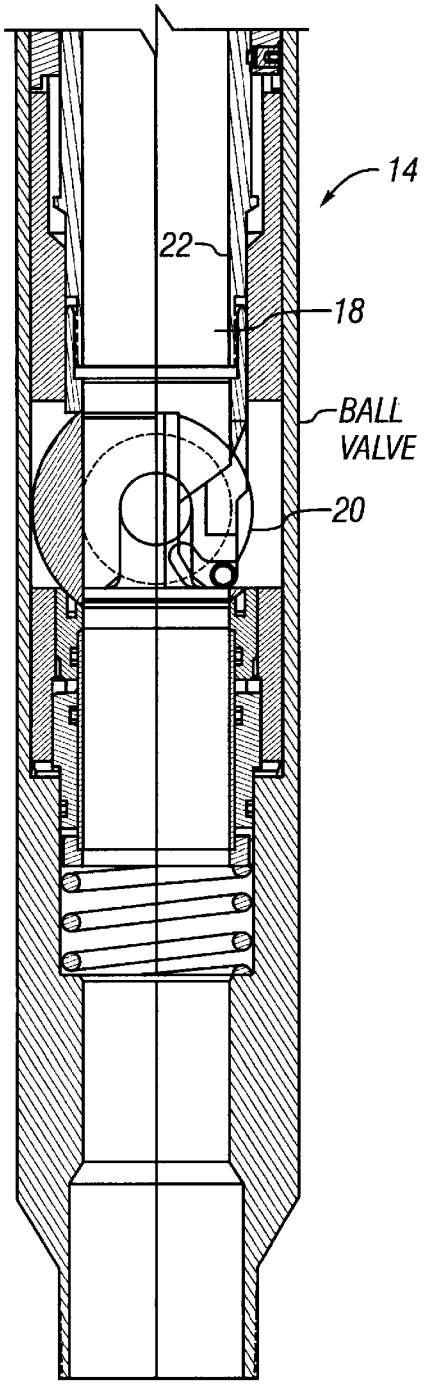
Figure 2:
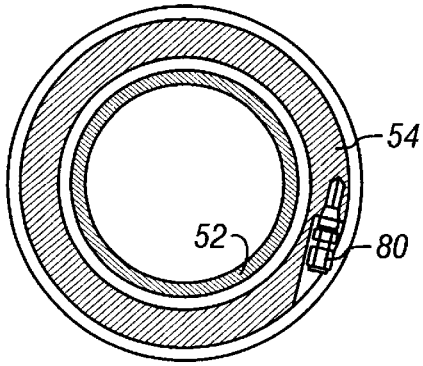
FIG. 2 is a sectional view of the tool string of FIGS. 1A–1H taken along section line A—A shown in FIG. 1F.
Figure 3:
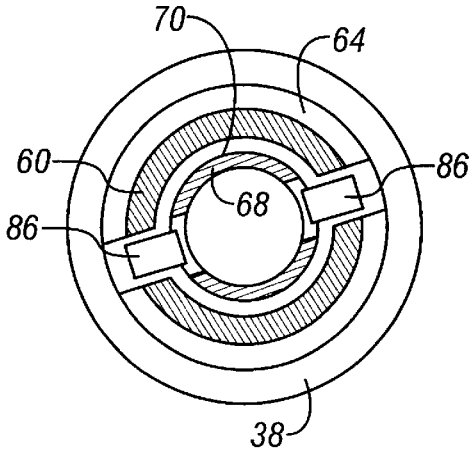
FIG. 3 is a sectional view of the tool string of FIGS. 1A–1H taken along section line B—B shown in FIG. 1G.

Upper string 12 includes a stinger assembly 28 and a valve actuator mechanism 30 (FIG. 1F). Upper string 12 may also include a safety valve 24 (FIG. 1D) that may be hydraulically actuated, and/or a crossover 26 (FIG. 1A).

At its lower end, stinger assembly 28 includes a bearing 42 and a stinger collet 44. When upper string 12 is properly positioned into lower string 14, as shown in FIG. 1G, bearing 42 abuts ball operator mandrel 22, and fingers 46 of stinger collet 44 are located within grooves 48 defined on the exterior surface 50 of ball operator mandrel 22. Fingers 46 are disposed between lower housing 38 and ball operator mandrel 22. Stinger collet 44 and bearing 42 are attached to the lower end of an actuating piston 52 which is movably disposed within an upper housing 54.

A seal stack 56 is disposed around the exterior of upper housing 54. When upper string 12 is properly positioned into lower string 14, a portion of upper housing 54 stabs into a portion of lower housing 38, and seal stack 56 forms a seal between upper and lower housings 38 and 54, respectively.

Near the top of lower housing 38, the interior surface of lower housing 38 includes threads 58. In one embodiment, threads 58 are left-handed threads. A threaded collet 60, which includes threads 62 on fingers 64 that match lower housing threads 58, is disposed on the exterior of upper housing 54. When upper string 12 is properly positioned into lower string 14, finger threads 62 are engaged to lower housing threads 58.

Upper housing 54 also includes a locking mechanism 66 to lock the engagement between finger threads 62 and lower housing threads 58. Locking mechanism 66 comprises a locking piston 68 that includes an extension section 70 that slides between threaded collet 60 and upper housing 54, ensuring that finger threads 62 are securely engaged to lower housing threads 58. Threaded collet 60 and locking piston 68 include slots 72, 82 that are aligned. At least one peg 74 is attached to upper housing 54 and located within the aligned slots 72, 82 to prevent relative rotation between threaded collet 60 and locking piston 68. When locking piston 68 is positioned so that extension section 70 is between threaded collet 60 and upper housing 54, a snap ring 76 disposed within upper housing 54 snaps into a groove 78 defined on the exterior surface of locking piston 68, thereby fixing locking piston 68 in the appropriate position.

The upper surface of locking piston 68 is in fluid communication with a lower chamber 84 that is in fluid communication with a lower control line 80. Initially, locking piston 68 is located within lower chamber 84 so that extension section 70 is not between threaded collet 60 and upper housing 54. When desired, control line 80 is pressurized to force locking piston 68 downward until extension section 70 is between threaded collet 60 and upper housing 54, and snap ring 76 is locked within groove 78.

A plurality of dogs 86, each attached to upper housing 54 such as by screws 88, are preferably disposed circumferentially between threaded collet fingers 64. Extension section 70 preferably also slides underneath dogs 86. Dogs 86 are preferably located within dog grooves 90 defined on the exterior surface of upper housing 54. Dogs 86 serve to transfer torque to threaded collet 60, as will be described below.

In operation, an operator initially stabs upper string 12 into lower string 14 so that: (1) bearing 42 abuts ball operator mandrel 22; (2) fingers 46 of stinger collet 44 are located within grooves 48 and disposed between lower housing 38 and ball operator mandrel 22; and (3) finger threads 62 of threaded collet 60 are engaged to lower housing threads 58. Next, when an operator is prepared to lock upper string 12 to lower string 14, control line 80 is pressurized to move locking piston 68 so that extension section 70 is between threaded collet 60 (dogs 86) and upper housing 54, and snap ring 76 is locked within groove 78. At this point, upper string 12 is mechanically locked to lower string 14.

In one embodiment, ball valve 20 is in the closed position when first deployed in the well and ball collet fingers 34 are snapped into upper ball grooves 40. As upper string 12 is positioned into lower string 14, bearing 42 will abut the top of ball operator mandrel 22 and force ball operator mandrel 22 downward. This movement will cause ball collet fingers 34 to snap out of upper ball grooves 40 and slide downward until they snap into lower ball grooves 38, thereby opening ball valve 20. Thus, the stabbing of upper string 12 into lower string 14 forces ball valve 20 to move from its closed position to its open position.

Once upper string 12 is locked to lower string 14, ball valve 20 may be operated (closed/opened) hydraulically. Actuating piston 52 has an annular extension 100 whose upper surface is in fluid communication with an upper chamber 102 that is in fluid communication with an upper control line 104. In one embodiment, a rupture disk 106 is disposed between the lower surface of annular extension 100 and lower chamber 84. Once upper string 12 is locked to lower string 14, lower control line 80 is pressurized above the rating of rupture disk 106 to cause disk 106 to burst, providing fluid communication between lower chamber 84 and the lower surface of annular extension 100. This pressurization forces annular extension 100, and correspondingly actuating piston 52, to move upward. In turn, as actuating piston 52 moves upward, fingers 46 of stinger collet 44 abut the top ends 108 of grooves 48, thereby also forcing the upward movement of ball operator mandrel 22. This upward movement causes ball collet fingers 34 to snap out of lower ball grooves 38 and slide upward until they snap into upper ball grooves 40, thereby closing ball valve 20.

The operator may thereafter open ball valve 20 again by pressuring upper chamber 102 through upper control line 104, thereby causing annular extension 100 and actuating piston 52 to move downward so that bearing 42 forces ball operator mandrel 22 downward. Concurrently, stinger collet fingers 46 slide between lower housing 38 and ball operator mandrel 22. The downward movement will cause ball collet fingers 34 to snap out of upper ball grooves 40 and slide downward until they snap into lower ball grooves 38, thereby opening ball valve 20. Ball valve 20 may thereafter be repeatedly closed and opened, as discussed above, by alternately pressuring lower and upper control lines 80 and 104, respectively.

When the operator is ready to retrieve upper string 12, he may do so without having to also retrieve lower string 14. First, the operator rotates upper string 12 in the appropriate direction to unscrew the threaded connection between collet finger threads 62 and lower housing threads 58. For instance, if lower housing threads 58 are left-handed threads, upper string 12 would be rotated to the right to disengage such threaded connection. It is noted that the fixed connection between the plurality of dogs 86 and upper housing 54 ensures that the torque applied to upper housing 54 is transferred to threaded collet 60. This rotational motion causes the upward movement of upper housing 54, including actuating piston 52. As previously discussed, upward movement of actuating piston 52 in turn causes fingers 46 of stinger collet 44 to abut top ends 108 of grooves 48, thereby also forcing the upward movement of ball operator mandrel 22. This upward movement causes ball collet fingers 34 to snap out of lower ball grooves 38 and slide upward until they snap into upper ball grooves 40, thereby closing ball valve 20.

Continued upward movement of upper housing 54 (including after the disengagement of the threaded connection) results in the disengagement of stinger collet 44 from ball operator mandrel 22. Once the threaded connection is disengaged and stinger collet 44 is disengaged from ball operator mandrel 22, upper string 12 can be retrieved to the surface. It is noted that this mechanism/procedure ensures that ball valve 20 will be closed each time upper string 12 is disengaged from lower string 14, thereby enabling retrieval of upper string 12 (including any additional components such as safety valve 24 and crossover 26) without having to kill the well.

During operation (and when ball valve 20 is open), hydrocarbons will be produced into tool string 10 below ball valve 20 and will flow upward through passageway 18. In the embodiment including crossover 26, flow of hydrocarbons can be diverted to an annulus 302 of the wellbore through crossover ports 300, in which case the hydrocarbons flow to the surface within annulus 302. In one embodiment, all of the flow is diverted to annulus 302 by including a plug (not shown) on completion string 304 above crossover 26. In another embodiment, flow may be partially diverted to annulus 302 so that hydrocarbons flow to the surface through both passageway 18 and annulus 302. Flowing hydrocarbons through annulus 302 is advantageous since the area of annulus 302 in some wells is smaller than the area of passageway 18.

Although only a few example embodiments of the present invention are described in detail above, those skilled in the art will readily appreciate that many modifications are possible in the example embodiments without materially departing from the novel teachings and advantages of this invention. Accordingly, all such modifications are intended to be included within the scope of this invention as defined in the following claims. It is the express intention of the applicant not to invoke 35 U.S.C. § 112, paragraph 6 for any limitations of any of the claims herein, except for those in which the claim expressly uses the words 'means for' together with an associated function.

We claim:

1. A tool string for deployment in a wellbore, comprising:

an upper string including a valve actuator;

a lower string including a valve; in which the lower string is adapted to form a releasable connection with the upper string to permit the upper string to be removed from the lower string when the lower string is deployed in the wellbore; and the valve actuator controls the operation of the valve once the upper string is received by the lower string, wherein the upper string is adapted to be connected to the lower string after the lower string is deployed in the wellbore.

2. The tool string of claim 1 in which the upper string is adapted to be retrievable from the lower string.

3. The tool string of claim 1 in which the upper string can be run into and retrieved from the well multiple times.

4. The tool string of claim 1 in which the valve actuator comprises an upper mandrel.

5. The tool string of claim 4 in which the valve actuator further comprises a bearing on one end of the upper mandrel.

6. The tool string of claim 4 in which the valve actuator further comprises an upper collet.

7. The tool string of claim 1 in which the valve actuator further comprises:

an upper mandrel having a piston;

a bearing on a lower end of the upper mandrel; and an upper collet.

8. The tool string of claim 7 further comprising:

an upper control line disposed on or in the upper string to provide pressurized fluid to an upper side of the piston;

a lower control line disposed on or in the upper string to provide pressurized fluid to a lower side of the piston.

9. The tool string of claim 8 further comprising a rupture disk disposed in the lower control line.

10. The tool string of claim tin which the valve is a ball valve.

11. The toot string of claim 1 in which the lower string further includes a lower mandrel linked to the valve.

12. The tool string of claim 11 in which the valve actuator further comprises:

an upper mandrel having a piston;

a bearing on a lower end of the upper mandrel; and an upper collet releasably engaged to the lower mandrel.

13. The tool string of claim 11 in which the lower string further includes a lower collet.

14. The tool string of claim 13 in which the lower collet releasably locks the valve open and closed.

15. The tool string of claim 1 further comprising a lock to secure the upper string to the lower string.

16. The tool string of claim 1 further comprising:

a crossover in fluid communication with the upper string; and a plug disposed in the crossover.

17. The tool string of claim 1, wherein the upper string is adapted to be stabbed into the lower string after the lower string has been deployed in the wellbore.

18. A completion apparatus for use in a well, comprising:

an upper section having an upper housing and an upper mandrel moveably mounted to the upper housing;

a lower section having a lower housing, a lower mandrel moveably mounted to the lower housing, and a valve mounted to the lower housing and connected to the lower mandrel; in which the lower section is adapted to releasably receive a portion of the upper section alter the lower section is deployed in the well; and displacement of the upper mandrel when the upper section is received by the lower section induces displacement of the lower mandrel to open or close the valve, wherein the upper section is adapted to be stabbed into the lower section after the lower section is deployed in the well.

19. The completion apparatus of claim 18 further comprising:

a crossover in fluid communication with the upper section; and a plug disposed in the crossover.

20. The completion apparatus of claim 18 in which the upper mandrel has:

a piston; and an upper collet attached to the upper mandrel.

21. The completion apparatus of claim 20 further comprising:

an upper control line to deliver pressurized fluid to an upper surface of the piston;

a lower control line to deliver pressurized fluid to a lower surface of the piston.

22. The completion apparatus of claim 20 further comprising a pressure-sensitive impediment to flow in the lower control line.

23. The completion apparatus of claim 20 in which the upper collet releasably engages the lower mandrel.

24. The completion apparatus of claim 18 further comprising a lower collet attached to the lower mandrel.

25. The completion apparatus of claim 24 comprising upper and lower recesses in the lower housing in which the lower collet releasably locks the valve open and closed.

26. The completion apparatus of claim 18 further comprising a lock to secure the upper housing to the lower housing.

27. The completion apparatus of claim 26 in which to lock comprises a locking piston and aligned slots in which a pin fixed to the upper housing slides.

28. The completion apparatus of claim 26 in which the lock comprises an snap ring.

29. The completion apparatus of claim 26 in which the lock is actuated by pressurized fluid from a control line.

30. The completion apparatus of claim 18 further comprising a safety valve upstream of the lower housing.

31. The completion apparatus of claim 18 in which the valve is a ball valve.

32. A tool string for use in a well, comprising:

an upper housing;

a lower housing releasably joined to the upper housing;

a passageway extending through the upper and lower housings to allow fluid communication through the tool string;

a valve disposed in the lower housing to block or allow flow through the passageway;

a valve linkage disposed in the lower housing;

a valve actuator moveably attached to the upper housing and releasably attached to the valve linkage; and a first control line disposed along or within the upper housing to control the movement of the valve actuator.

33. The tool string of claim 32 in which the valve is a ball valve.

34. The tool string of claim 32 in which the lower housing is releasably joined to the upper housing by a threaded connection.

35. The tool swing of claim 34 in which the threaded connection is formed by a threaded upper collet attached to the upper housing and mating threads on the lower housing.

36. The tool string of claim 32 in which the first control line delivers pressurized fluid to the valve actuator to move the valve actuator.

37. The tool string of claim 32 in which the valve is a ball valve.

38. The tool string of claim 32 further comprising:

a crossover having crossover ports therein;

a plug in the tool string upstream of the crossover ports; and a safety valve disposed in the tool string.

39. The tool swing of claim 32 further comprising:

a second control line to induce motion of the valve actuator in a direction opposite to that induced by the first control line; and a rupture disk disposed in the second control line.

40. The tool string of claim 32 further comprising an upper collet to releasably attached to the valve actuator to the valve linkage.

41. The tool string of claim 32 in which joining the upper housing to the lower housing forces the valve open.

42. The tool string of claim 32 in which removing the upper housing from the lower housing forces the valve closed.

43. The tool string of claim 32 further comprising a lock.

44. The tool sting of claim 43 which the lock comprises a snap ring and a locking piston.

45. The tool string of claim 32 further comprising a lower collet to releasably lock the valve linkage to the lower housing.

46. A method to control flow in a well, comprising:

(a) placing a lower housing having a valve therein into the well;

(b) fixing to lower housing to the well;

(c) subsequent to the fixing, receiving by the lower housing an upper housing having a valve actuator therein, wherein the receiving comprises stabbing the upper housing into the lower housing subsequent to the fixing;

(d) moving the valve actuator to open or close the valve as many times as desired;

(e) disconnecting the upper housing from the lower housing with the valve closed to permit other operations upstream of the lower housing; and (f) repeating steps (c)–(e) as many times as desired.

47. A method to retrieve a tool string from a well, comprising:

running into the well the tool string comprising first and second releasably connected sections, the first section having a valve actuator, and the second section having a valve responsive to the valve actuator, wherein the running the first section into the well comprises stabbing the first section into the second section;

securing the second section in the well in a desired position;

separating the first section from the second section and thereby closing the valve;

removing the first section from the well;

performing operations in the well upstream of the valve; and running the first section into the well to releasably connect the first section to the second section and thereby open the valve.

48. A flow control system for use in a well, comprising:

a first section releasably connected to a second section, to permit the first section to be removed from the second section when the second section is deployed in the well, wherein the first section is adapted to be stabbed into the second section after the section is deployed in the well;

a valve disposed in the second section; and a valve actuator disposed in the first section to open and close the valve when the first section is connected to the second section.

49. A flow control valve for use in a well, comprising:

a lower housing;

a sealing member disposed in the lower housing;

a linkage connected on one end to the sealing member;

an upper housing releasably connected to the lower housing, wherein the upper housing is adapted to be stabbed into the lower housing after the lower housing is deployed in the well;

an actuator connected at one end to the upper housing and releasably connected at an opposite end to an end of the linkage opposite the sealing member to permit the actuator to be removed from the linkage when the lower housing is deployed in the well.

* * * * *

UNITED STATES PATENT AND TRADEMARK OFFICE

CERTIFICATE OF CORRECTION

PATENT NO. : 6,715,557 B2
DATED : April 6, 2004
INVENTOR(S) : Rodney J Wetzel et al.

It is certified that error appears in the above-identified patent and that said Letters Patent is hereby corrected as shown below:

Title page,
Item [75], Inventors, delete "Meschall, Andar" and insert -- Mescall, Rio de Janeiro --.

Signed and Sealed this

Thirty-first Day of August, 2004

JON W. DUDAS
*Director of the United States Patent and Trademark Office*